US012758019B2

(12) United States Patent
Yoon

(10) Patent No.: US 12,758,019 B2
(45) Date of Patent: Oct. 13, 2026

(54) ARMREST ASSEMBLY AND CHAIR COMPRISING SAME

(71) Applicant: SIDIZ INC., Pyeongtaek-si (KR)

(72) Inventor: Dae Ho Yoon, Seoul (KR)

(73) Assignee: SIDIZ INC., Pyeongtaek-si (KR)

( * ) Notice: Subject to any disclaimer, the term of this patent is extended or adjusted under 35 U.S.C. 154(b) by 97 days.

(21) Appl. No.: 18/917,461

(22) Filed: Oct. 16, 2024

(65) Prior Publication Data

US 2025/0031856 A1 Jan. 30, 2025

Related U.S. Application Data

(63) Continuation of application No. PCT/KR2023/005337, filed on Apr. 20, 2023.

(30) Foreign Application Priority Data

Apr. 25, 2022 (KR) ..... 10-2022-0050551

(51) Int. Cl.
*A47C 7/54* (2006.01)
*A47C 7/02* (2006.01)

(52) U.S. Cl.
CPC ..... *A47C 7/541* (2018.08); *A47C 7/02* (2013.01)

(58) Field of Classification Search
CPC ..... A47C 7/541; A47C 7/02
See application file for complete search history.

(56) References Cited

U.S. PATENT DOCUMENTS

2006/0226691 A1* 10/2006 Bedford ..... A47C 1/0308 297/411.36

FOREIGN PATENT DOCUMENTS

| | | | | | |
|---|---|---|---|---|---|
| CN | 208403806 | U | | 1/2019 | |
| CN | 112167874 | A | | 1/2021 | |
| JP | 2004-188072 | A | | 7/2004 | |
| JP | 2013-233167 | A | | 11/2013 | |
| JP | 2019042108 | A | * | 3/2019 | ..... A47C 1/03 |
| JP | 7023073 | B2 | * | 2/2022 | ..... A47C 1/03 |
| KR | 10-2016648 | B1 | | 8/2019 | |
| KR | 10-2021-0015185 | A | | 2/2021 | |
| RU | 2518280 | C2 | | 6/2014 | |

(Continued)

OTHER PUBLICATIONS

International Search Report for PCT/KR2023/005337 mailed Jul. 26, 2023 from Korean Intellectual Property Office.

(Continued)

*Primary Examiner* — Anthony D Barfield

(74) *Attorney, Agent, or Firm* — Paratus Law Group, PLLC

(57) ABSTRACT

An armrest assembly includes: an arm frame body having formed therein an inner space with an open upper end, and mediating coupling to a seat portion; an inner body which is inserted to be arranged in the inner space of the arm frame body, and is arranged to be movable in up and down directions according to the manipulation of a user; an arm support pad which is connected to the upper portion of the inner body, on which the arm of the user is placed and supported, and which has a front end portion rotatable in the left and right horizontal directions due to an external force provided by the user; and a frictional ring which provides the frictional force between the inner body and the arm support pad.

9 Claims, 9 Drawing Sheets

(56) References Cited

FOREIGN PATENT DOCUMENTS

WO WO 2022/018645 A1 1/2022

OTHER PUBLICATIONS

Korean Office Action for related KR Application No. 10-2022-0050551 mailed May 27, 2024 from Korean Intellectual Property Office.
Japanese Office Action for related JP Application No. 2024-562000 mailed Aug. 26, 2025 from Japan Patent Office.
Russian Office Action for related RU Application No. 2024130568 mailed Jun. 5, 2025 from Federal Service for Intellectual Property of the Russian Federation.

* cited by examiner

ARMREST ASSEMBLY AND CHAIR COMPRISING SAME

CROSS-REFERENCE TO PRIOR APPLICATIONS

This application is a Continuation application of PCT International Application No. PCT/KR2023/005337 (filed on Apr. 20, 2023), which claims priority to Korean Patent Application No. 10-2022-0050551 (filed on Apr. 25, 2022), which are all hereby incorporated by reference in their entirety.

BACKGROUND

The present disclosure relates to an armrest assembly and a chair including the same, and more specifically, to an armrest assembly and a chair including the same, in which an arm support pad is configured to be rotated (rotated) with respect to an inner body, thereby improving user convenience by adjusting a rotational force (frictional force) for each user and preventing random loose of a hinge screw being a rotation center.

To improve a user's convenience, recently released home and office chairs are configured to be provided so that a seat part on which a user sits has an adjustable height and slides in a front-rear direction to be provided to have an adjustable seating position according to the user's type, and also provided so that a backrest part supporting a back portion of a user has an upper end portion provided to tilt at a predetermined angle in the front-rear direction with respect to a lower end portion to enable more comfortable seating life for the user.

In addition, an armrest assembly provided at both end portions of the seat part to rest the user's arms may also be configured so that its height may be adjusted, a portion thereof slides in a front-rear direction, or a front end portion or a rear end portion is rotated (rotated) around any hinge shaft in a left-right direction, thereby maximizing the use convenience of the user.

To constitute the armrest assembly according to the related art to rotate in a left-right direction, a component positioned relatively above a component positioned relatively at a lower portion of the conventional armrest assembly is rotated, and the two components are assembled to rotate using a hinge screw, and an additional component for providing the sense of manipulation (a manipulation force or a rotational force) to a user upon relative rotation between the two components is included.

However, since a manipulation sense provision part of the armrest assembly according to the related art is configured to provide only a predetermined sense of manipulation to the user and is not configured to customize the magnitude (manipulation force) of the sense of manipulation for each user, there is inconvenience of having to newly replace the configuration of the manipulation sense provision part to provide user customized sense of manipulation.

In addition, the manipulation sense provision part of the armrest assembly according to the related art also has a problem that noise greatly occurs when the sense of manipulation occurring through predetermined interference is generated on a rotational path between a rotating component and a fixed component.

In addition, the armrest assembly according to the related art has a movement problem of an element configured to be rotated by random loose of a hinge screw caused by the repeated rotation manipulation of the user when the hinge screw connecting components to be relatively rotated among components of the armrest assembly is fastened using a complete assembly strength.

The present disclosure has been made in efforts to solve the above technical problems and is directed to providing an armrest assembly and a chair including the same, in which an arm support pad is configured to be rotated (rotated) with respect to an inner body and a rotational force (frictional force) is adjusted for each user, thereby improving use convenience and preventing random loose of a hinge screw being a rotation center.

The objects of the present disclosure are not limited to the above-described object, and other objects that are not mentioned will be able to be clearly understood by those skilled in the art from the following description.

An armrest assembly according to one embodiment of the present disclosure includes an arm frame body in which an inner space with an open upper end portion is formed and which mediates coupling to a seat part on which a user sits, an inner body disposed by being inserted into the inner space of the arm frame body and disposed to be moved vertically by the user's manipulation, an arm support pad which is connected to an upper portion of the inner body, on which the user's arms are supported by being rested, and which is provided to have a front end portion rotated by an external force provided by the user in a horizontal direction, and a frictional ring disposed between the inner body and the arm support pad and providing a frictional force between the inner body and the arm support pad when the arm support pad rotates with respect to the inner body, wherein the frictional force by the frictional ring is determined by an assembly force of a hinge screw connecting the inner body to the arm support pad.

Here, the inner body may include a height adjustment case inserted into the inner space of the arm frame body to adjust a height and a connection part provided at an upper end of the height adjustment case and mediating the relative rotation connection of the arm support pad, and the frictional ring may be seated in a circular installation groove formed in an upper surface of the connection part.

In addition, the frictional force may be determined as an upper end portion of the frictional ring is compressed by a lower end portion of a ring-shaped compression boss protruding to a lower portion of the arm support pad.

In addition, the frictional ring may be formed with a plurality of locking protrusions protruding downward from a lower surface thereof, and the plurality of locking protrusions may be fixedly inserted into a plurality of locking grooves formed in the circular installation groove.

In addition, the frictional ring may be an elastic body made of a rubber material.

In addition, the inner body may be provided with a screw fastening boss in which a screw fastening hole is formed, and the arm support pad may be provided with a screw through boss in which a screw through hole is formed at a position corresponding to the screw fastening hole, and the frictional ring may be compressed as a ring-shaped compression boss formed to protrude to the lower portion of the arm support pad is moved downward by an assembly force of the hinge screw fastened to the screw fastening hole of the screw fastening boss through the screw through hole of the screw through boss.

In addition, a flat washer may be interposed in the hinge screw to mediate transmission of an assembly force transmitted from the user to the ring-shaped compression boss.

In addition, a plurality of grooves may be repeatedly formed in an outer circumferential surface of the ring-shaped compression boss in the circumferential direction, and an operation sense provision part elastically supported toward the plurality of grooves to provide the sense of operation when the arm support pad rotates may be further provided on the upper surface of the connection part of the inner body.

In addition, the operation sense provision part may include a member case having an installation space that is open toward the plurality of grooves in the upper surface of the connection part of the inner body, an elastic rubber provided inside the installation space in the member case, and an operation pin having an inner end supported by the elastic rubber and a portion of outer surfaces supported to be engaged with the plurality of grooves.

A chair according to one embodiment of the present disclosure includes a seat part provided so that a user sits thereon, and an armrest assembly provided on both left and right end portions of the seat part and provided so that the user's arms are rested, wherein the armrest assembly includes an arm frame body in which an inner space with an open upper end portion is formed and which mediates coupling to the seat part, an inner body disposed by being inserted into the inner space of the arm frame body and disposed to be moved vertically by the user's manipulation, an arm support pad which is connected to an upper portion of the inner body, on which the user's arms are supported by being rested, and which is provided to have a front end portion rotated by an external force provided by the user in a horizontal direction, and a frictional ring disposed between the inner body and the arm support pad and providing a frictional force between the inner body and the arm support pad when the arm support pad rotates with respect to the inner body, wherein the frictional force by the frictional ring is determined by an assembly force of a hinge screw connecting the inner body to the arm support pad.

According to the armrest assembly and the chair including the same according to one embodiment of the present disclosure, it is possible to customize the rotational force (manipulation force) of the arm support pad for each user by adjusting the fastening strength of the hinge screw and prevent random loose of the hinge screw through the even distribution design of the frictional force through the frictional ring, thereby greatly improving user convenience.

Figure 1:
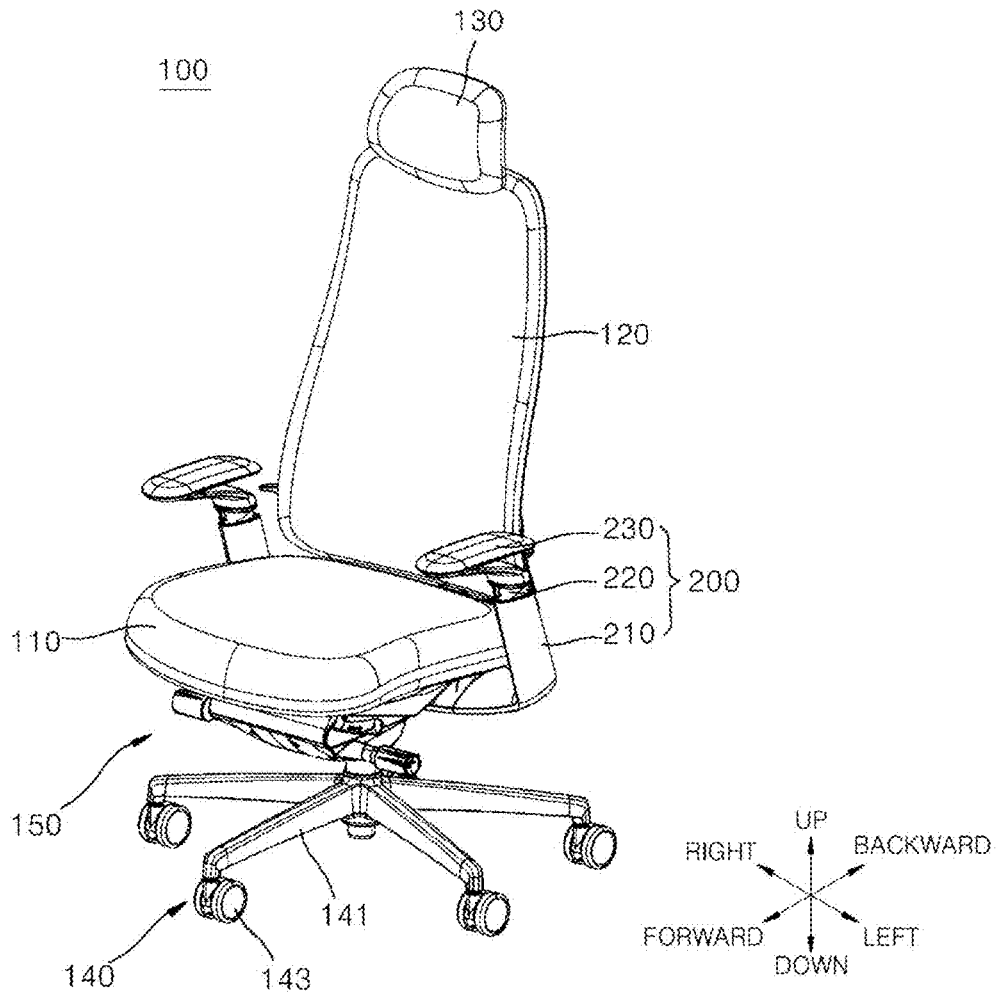
FIG. 1 is a perspective view showing an armrest assembly and a chair including the same according to one embodiment of the present disclosure.

| <Description of reference numerals> | |
|---|---|
| 100: | chair |
| 110: | seat part |
| 120: | backrest part |
| 130: | headrest part |
| 140: | leg part |
| 150: | manipulation part |
| 200: | armrest assembly |
| 210: | arm frame body |
| 220: | inner body |
| 221: | height adjustment case |
| 222: | connection part |
| 223: | upper surface of connection part |
| 224: | installation groove |
| 224a: | locking groove |
| 225: | frictional ring |
| 225a: | locking protrusion |
| 226: | operation sense provision part |
| 227: | member case |
| 228: | elastic rubber |
| 229: | operation pin |
| 230: | arm support |
| 231: | connection pad |
| 232: | support pad |
| 233h: | screw through hole |
| 234: | screw through boss |
| 235: | screw installation groove |
| 236: | ring-shaped compression boss |
| 237: | hole cover |
| 240: | hinge screw |
| 241: | flat washer |
| S: | safety space |

DETAILED DESCRIPTION

Hereinafter, an armrest assembly and a chair including the same according to one embodiment of the present disclosure will be described in detail with reference to the accompanying drawings.

In adding reference numerals to components in each drawing, it should be noted that the same components have the same reference numerals as much as possible even when they are illustrated in different drawings. In addition, in describing embodiments of the present disclosure, the detailed description of related known configurations or functions will be omitted when it is determined that the detailed description obscures the understanding of the embodiments of the present disclosure.

Terms such as first, second, A, B, (a), and (b) may be used to describe components of the embodiments of the present disclosure. The terms are only for the purpose of distinguishing a component from another, and the nature, sequence, order, or the like of the corresponding component is not limited by the terms. In addition, unless otherwise defined, all terms (including technical and scientific terms) used herein have the same meanings as those commonly understood by those skilled in the art to which the present disclosure pertains. The terms defined in a generally used dictionary should be construed as meanings that match with the meanings of the terms from the context of the related technology and are not construed as an ideal or excessively formal meaning unless clearly defined in this application.

FIG. 1 is a perspective view showing an armrest assembly and a chair including the same according to one embodiment of the present disclosure.

Referring to FIG. 1, as shown in FIG. 1, a chair 100 according to one embodiment of the present disclosure includes a seat part 110 which is horizontally disposed at a predetermined height from the ground and on which a user sits, a backrest part 120 disposed to be substantially perpendicular to a rear end portion of the seat part 110 and having an upper end portion disposed to tilt in a front-rear direction with respect to any tilting point of a lower end portion to support the user's back portion, a headrest part 130 disposed in the middle of an upper end portion of the backrest part 120 to support the user's back head portion, and a leg part 140 supporting the seat part 110 at a predetermined height from the ground.

In addition, the chair 100 according to one embodiment of the present disclosure may further include a manipulation part 150 disposed on a lower surface of the seat part 110 and provided to be connected to respective connecting portions of the seat part 110 and the backrest part 120 to manipulate the seat part 110 to slide in the front-rear direction and the backrest part 120 to tilt and move in the front-rear direction.

In addition, the chair 100 according to one embodiment of the present disclosure may further include an armrest assembly 200 for supporting both arms of a user seated on the seat part 110 at both left and right end portions of the seat part 110. Detailed description of the armrest assembly 200 will be described below.

The seat part 110 may be provided to slide in the front-rear direction with respect to a seat frame (not shown) so that a seating position may be adjusted according to the user's convenience.

More specifically, the seat part 110 may extend in the front-rear direction. The seat part 110 may be a part on which the user sits. The seat part 110 may support the user's buttocks and a thigh of each of the user's two legs.

Among an upper surface of the seat part 110, a rear portion that is a portion that supports the user's buttocks may be formed to be slightly recessed downward, and a front portion that is a portion that supports the two thighs of the user may be formed to be inclined to be close to a lower side as it goes forward.

The backrest part 120 may extend vertically and may extend to be inclined at a predetermined angle so that a lower end portion is positioned in front of an upper end portion. The lower end portion of the backrest part 120 may be hinge-coupled to a seat frame (not shown). Therefore, the upper end portion of the backrest part 120 may be adjusted to tilt around a hinge portion of the lower end portion in the front-rear direction.

The headrest part 130 may extend vertically and may be coupled to the center of the upper end portion of the backrest part 120. The headrest part 130 may be formed integrally with the backrest part 120 and may have a lower end portion coupled so that a horizontal shaft formed to extend laterally on a front surface of the upper end portion of the backrest part 120 becomes a rotation center and an upper end portion coupled to tilt in the front-rear direction.

Meanwhile, the leg part 140 may be disposed under the seat part 110 and provided to support the manipulation part 150. The leg part 140 may include a plurality of branch frames 141 disposed radially and a moving wheel 143 rotatably coupled to a lower portion of a front end of each of the branch frames 141.

The branch frames 141 may be formed so that five branch frames are branched at the same angle from the center, but it is sufficient that three or more are formed within the limit that supports the user's seating. Here, a cylinder device that is not shown but is installed to be recessed under the seat part 110 may be provided at the center of the branch frame 141, and a height of the seat part 110 may be adjusted by the user's manipulation of the manipulation part 150.

Figure 2:
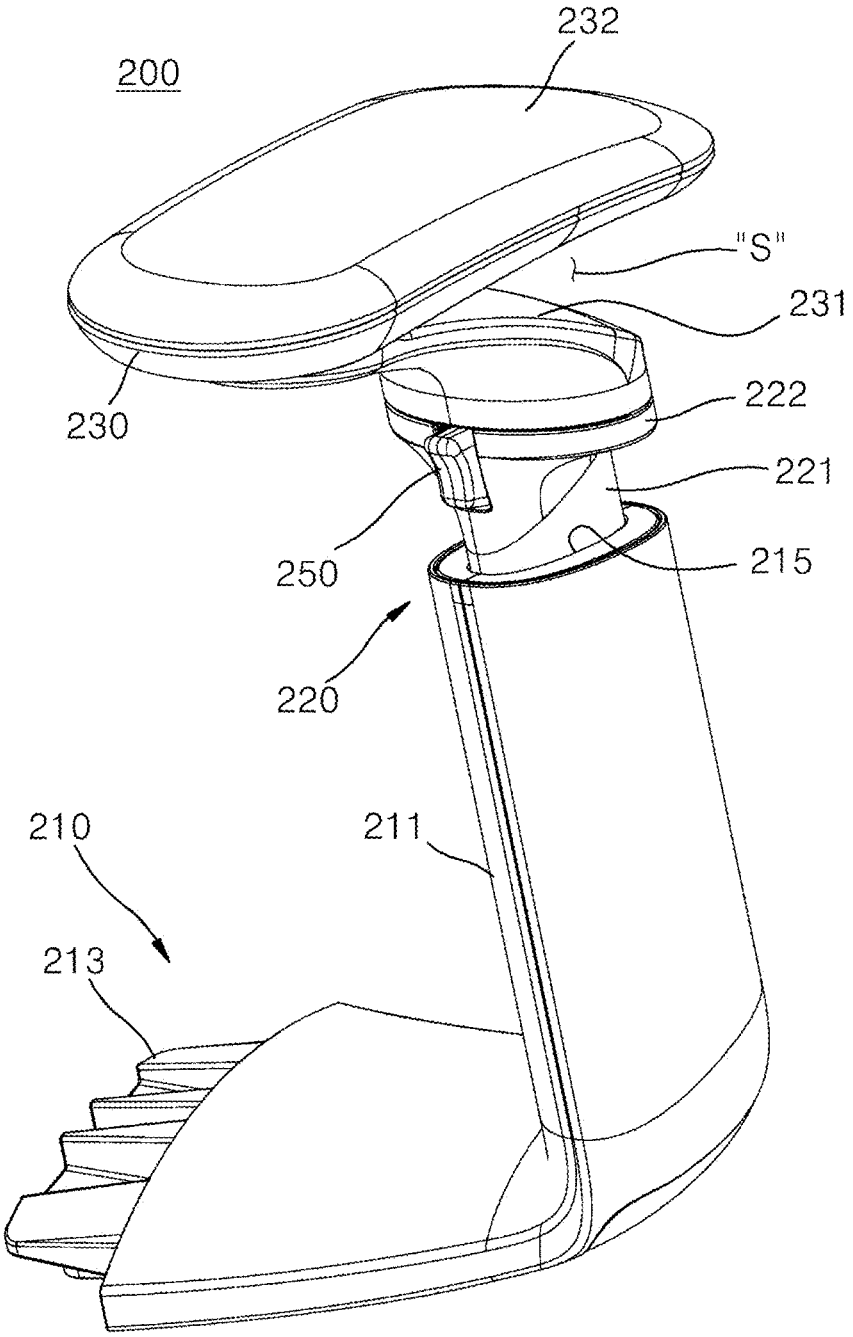
FIG. 2 is a perspective view showing the armrest assembly according to one embodiment of the present disclosure.
Figure 3:
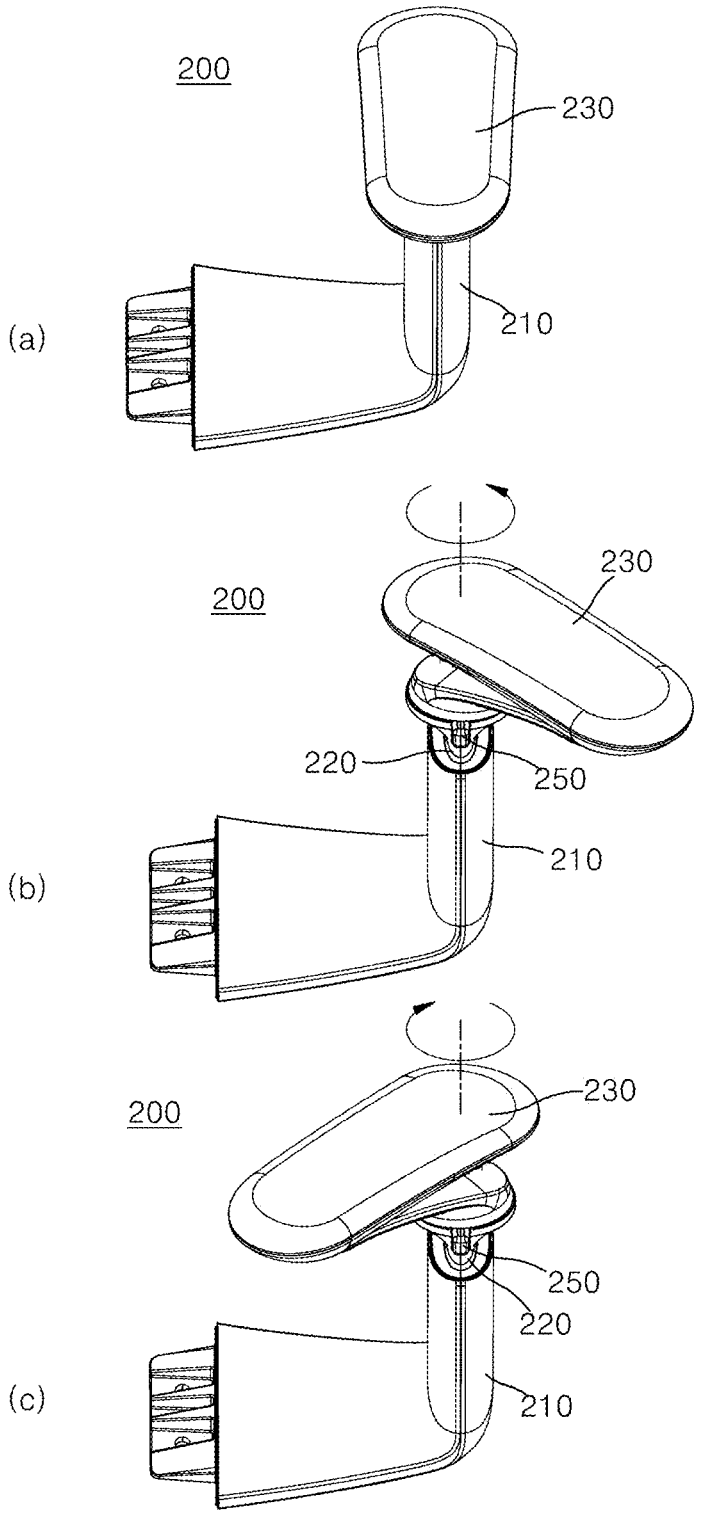
FIG. 3 is a perspective view showing various rotation states of an armrest pad among components of FIG. 2.
Figure 4A:
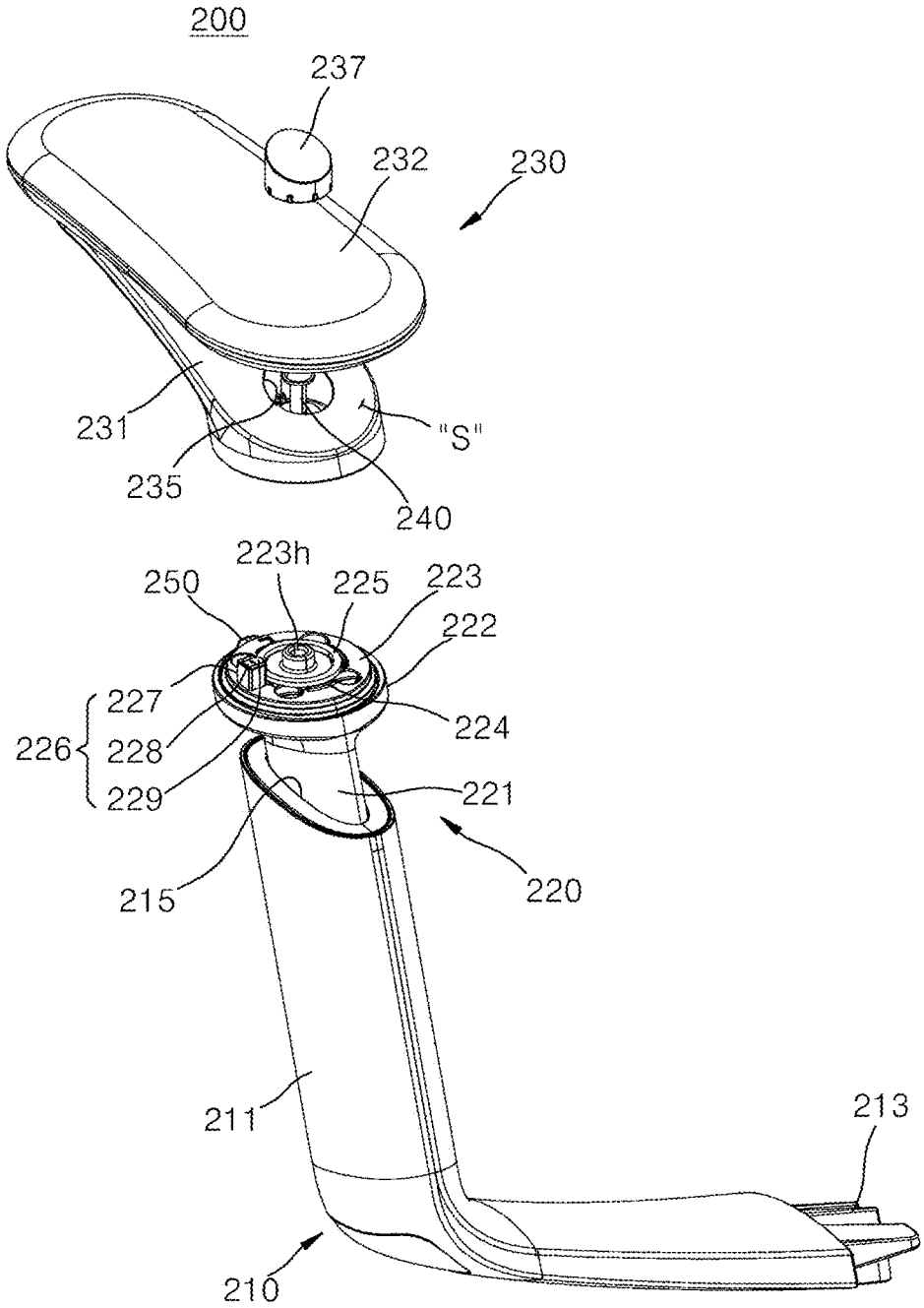
FIGS. 4A and 4B are downward and upward exploded perspective views of FIG. 2.
Figure 4B:
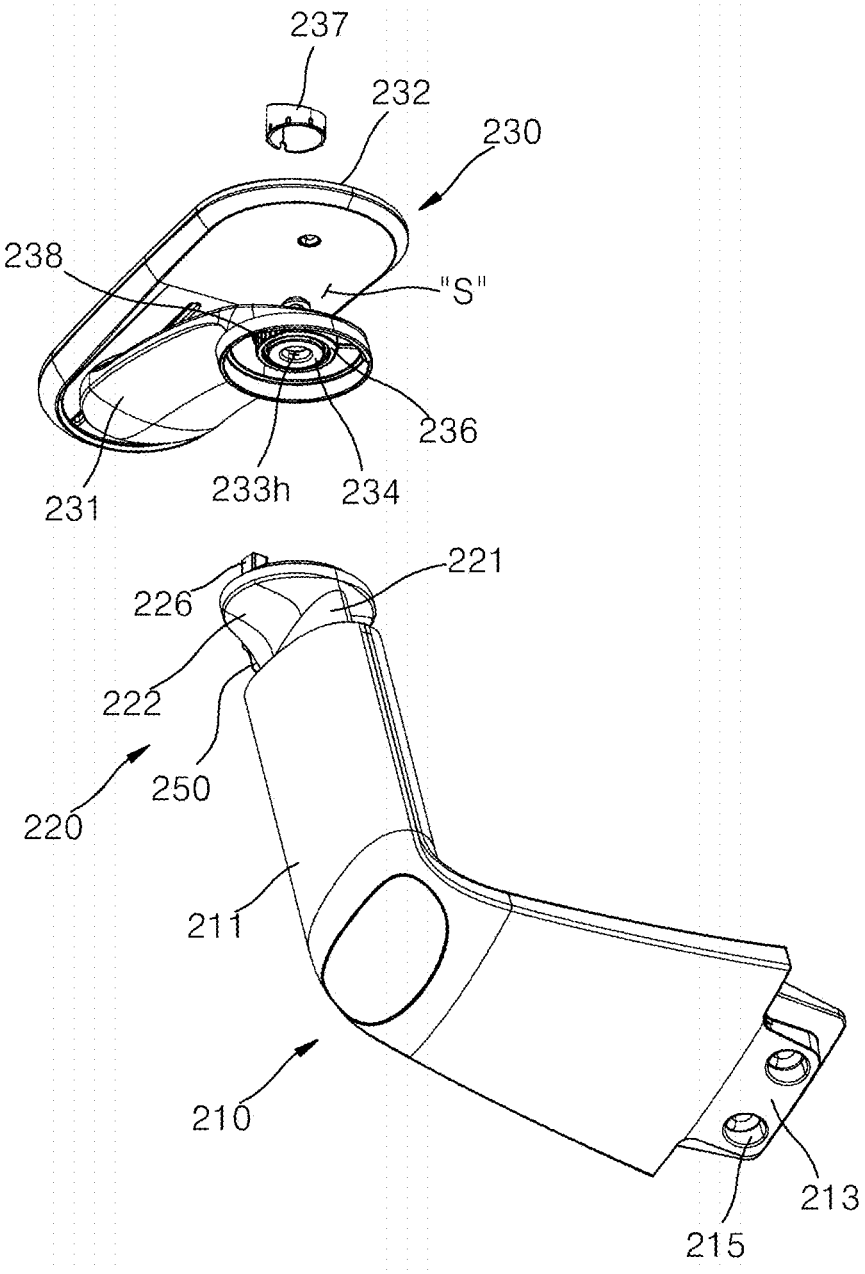
Figure 5:
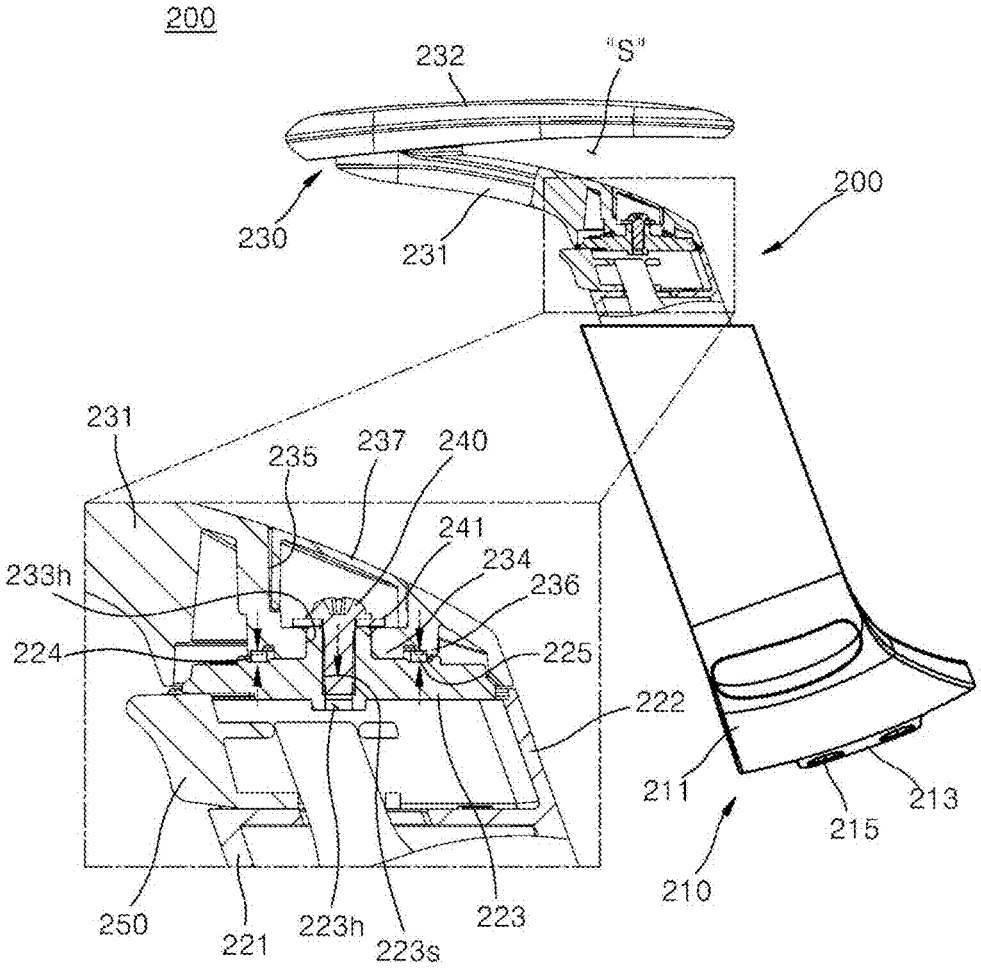
FIG. 5 is a side cross-sectional view of a portion of the armrest assembly according to one embodiment of the present disclosure and a partial enlarged view thereof.
Figure 6:
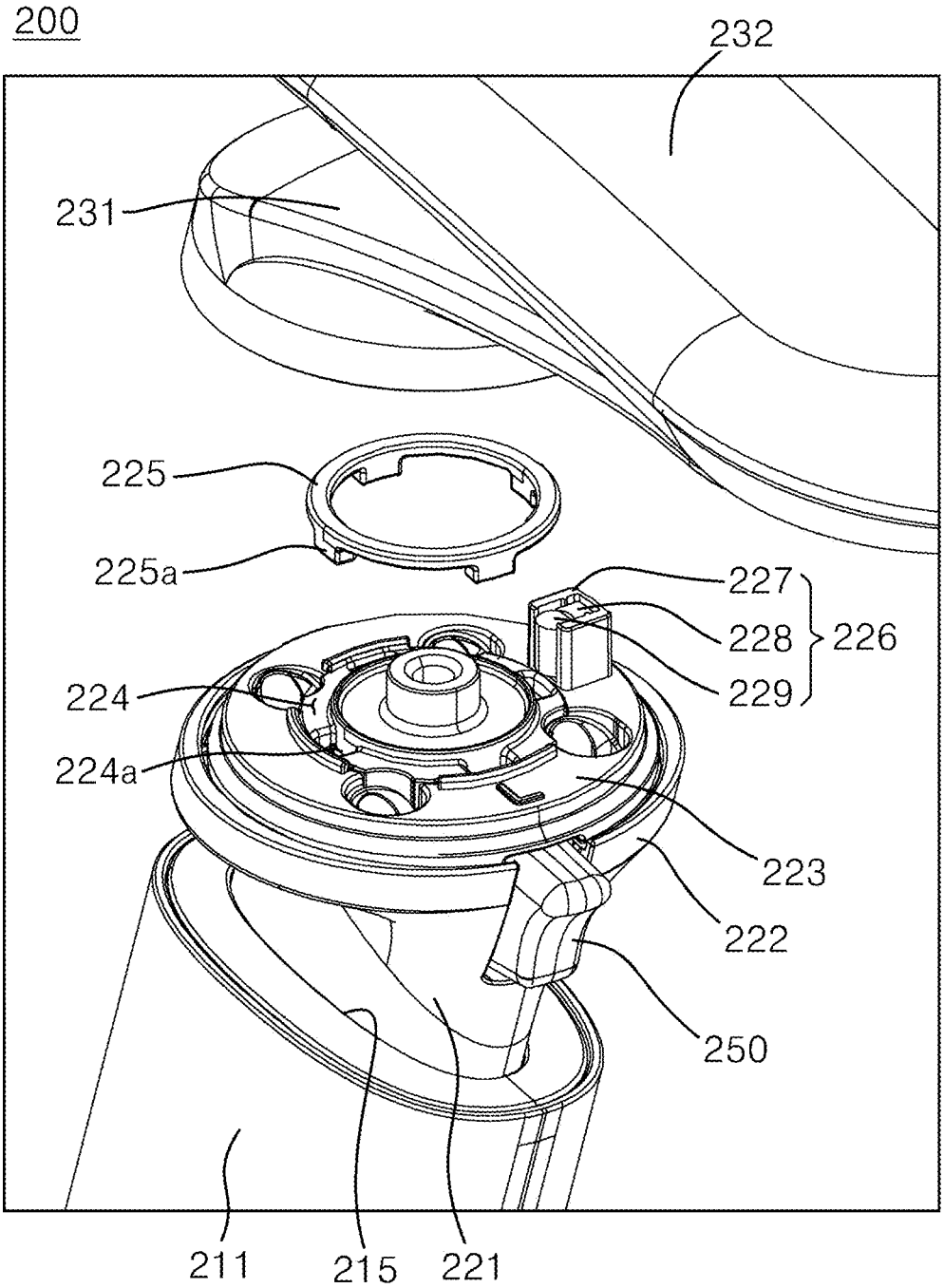
FIG. 6 is an exploded perspective view showing another embodiment of a frictional ring of the armrest assembly according to one embodiment of the present disclosure.
Figure 7A:
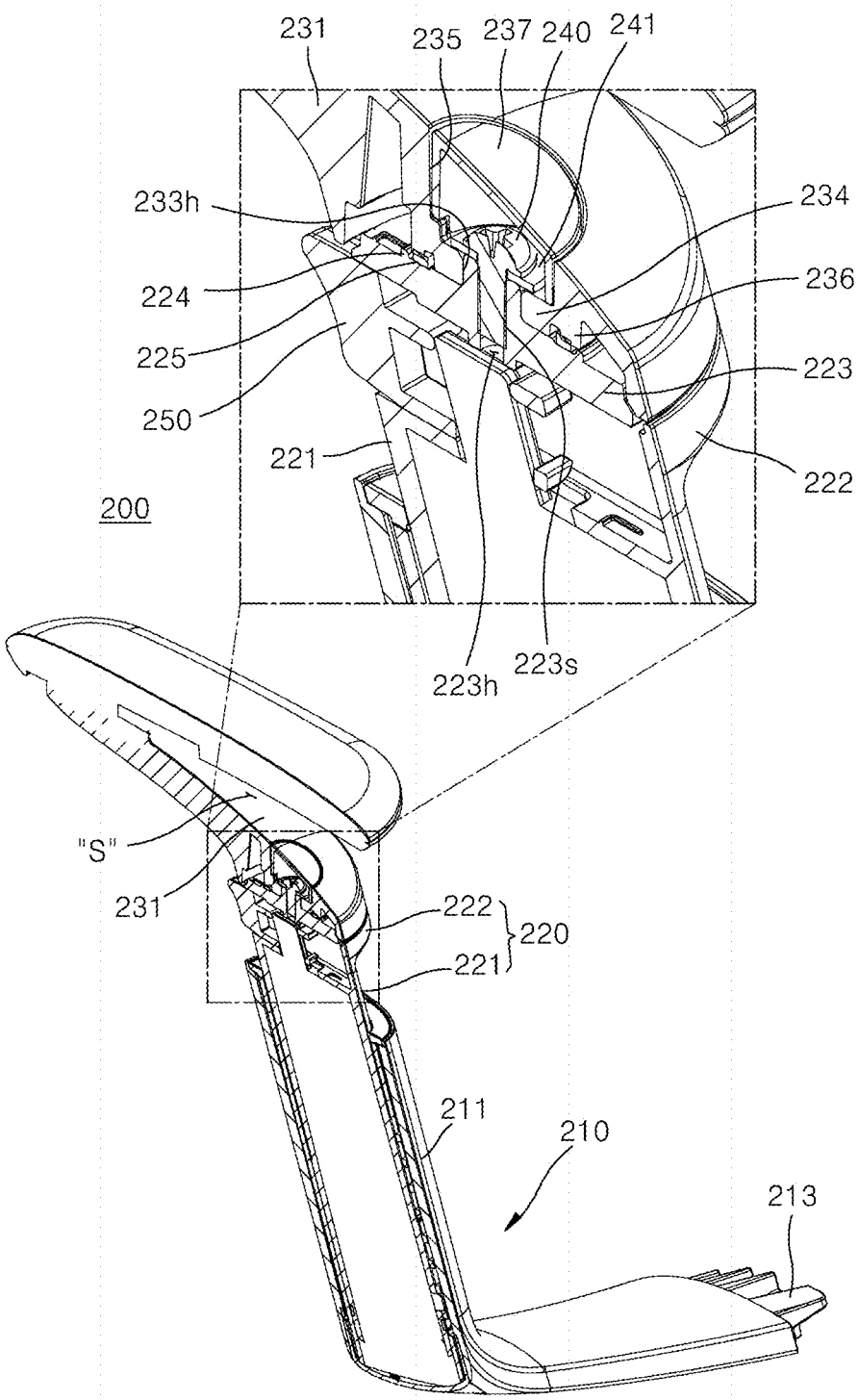
FIGS. 7A and 7B are a cut perspective view of a portion of the armrest assembly according to one embodiment of the present disclosure and a partial enlarged view thereof.
Figure 7B:
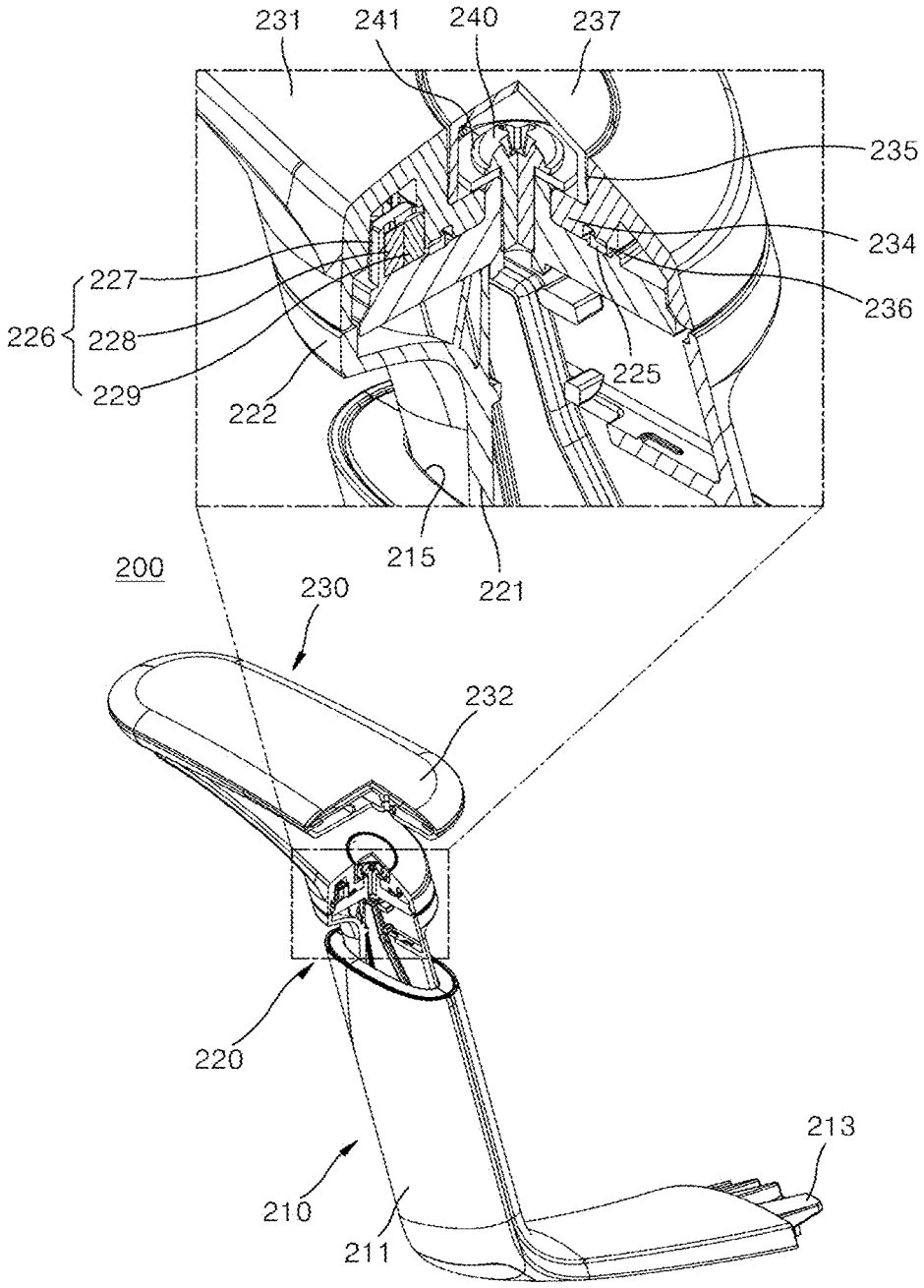

FIG. 2 is a perspective view showing the armrest assembly according to one embodiment of the present disclosure, FIG. 3 is a perspective view showing various rotation states of an armrest pad among components of FIG. 2, FIGS. 4A and 4B are downward and upward exploded perspective views of FIG. 2, FIG. 5 is a side cross-sectional view of a portion of the armrest assembly according to one embodiment of the present disclosure and a partial enlarged view thereof, FIG. 6 is an exploded perspective view showing another embodiment of a frictional ring of the armrest assembly according to one embodiment of the present disclosure, and FIGS. 7A and 7B are a cut perspective view of a portion of the armrest assembly according to one embodiment of the present disclosure and a partial enlarged view thereof.

As shown in FIGS. 1 and 2, the armrest assembly 200 includes an arm frame body 210 coupled to one side and the other side of a lower portion of both left and right end portions of the seat part 110 and extending upward to a predetermined height, an inner body 220 disposed by being inserted into the arm frame body 210 and disposed to be moved vertically by the user's manipulation, and an arm support pad 230 which is connected to an upper portion of the inner body 220 and on which the user's arms are rested and supported.

The armrest assembly 200 configured as described above may be provided so that an insertion end 213 formed at a lower end portion of the arm frame body 210 is substantially parallel to the lower surface of the seat part 110 and firmly connected by an assembly screw (not shown) assembled through a fastening member through hole 215 formed to vertically pass through the insertion end 213 after inserted into a coupling end (not shown) of the lower portion of both left and right end portions of the seat part 110.

The arm frame body 210 may have a portion, which extends to an upper portion excluding a portion parallel to the lower surface of the seat part 110, formed with an inner space in which the inner body 220 may be installed.

A height adjustment button 250 is provided to be exposed externally on an upper end portion of the inner body 220 installed by being inserted into the inner space of the arm frame body 210, and a rotation lock part (not shown) linked to the height adjustment button 250 is provided inside the inner body 220 so that the user may adjust the arm support pad 230 to a desired height.

More specifically, the inner body 220 may include a height adjustment case 221 inserted into the inner space of the arm frame body 210 to adjust the height, and a connection part 222 provided at an upper end of the height adjustment case 221 and mediating the relative rotation connection of the arm support pad 230.

That is, the arm support pad 230 may be provided to rotate in the left-right direction in a state in which the height is fixed around upper and lower rotation axes of the connection part 222 provided at an upper end of the inner body 220.

Meanwhile, as shown in FIGS. 1 and 2, the arm support pad 230 may include a connection pad 231 provided to rotate with respect to the connection part 222 of the inner body 220 and extending forward to be inclined upward, and a support pad 232 integrally connected to an upper side of a front end portion of the connection pad 231 and formed to extend to be parallel backward or inclined upward at a predetermined angle to substantially support the user's arms.

Here, a safety space S may be formed between respective rear end portions of the connection pad 231 and the support pad 232 to prevent the user's arm from being caught and injured when the tilting of the backrest part 120 is adjusted in the front-rear direction.

As shown in FIG. 3, the arm support pad 230 among the components of the armrest assembly 200 according to one embodiment of the present disclosure configured as described above may be provided to rotate around a hinge screw (see reference numeral "240" of FIGS. 4A and 4B) mediating coupling to the connection part 222 of the inner body 220 in the left-right direction.

That is, the user's arm may be rested in a state in which the arm support pad 230 is fixed to the center with respect to the hinge screw 240 according to the user's preference as shown in FIG. 3A, and the user's arm may be rested in a state in which a front end portion of the arm support pad 230 is rotated to the left or right at a predetermined angle with respect to the hinge screw 240 according to the user's preference as shown in FIG. 3B or 3C.

Meanwhile, as shown in FIGS. 4A and 4B, the arm support pad 230 may be rotatably connected to an upper surface of the connection part 222 of the inner body 220.

To this end, a screw installation hole 235 provided at a portion where the connection pad 231 is formed and provided to install the hinge screw 240 to be described below may be further formed in the safety space S of the arm support pad 230.

The screw installation hole 235 may be shielded by a hole cover 237 after the hinge screw 240 to be described below is installed. An outer surface of the hole cover 237 may be formed in a shape that matches an outer surface forming the safety space S side of the connection pad 231.

Here, the arm support pad 230 may be rotatably connected to the upper surface of the connection part 222 among the components of the inner body 220 via the hinge screw 240.

To this end, a screw fastening boss (no reference numeral) in which a screw fastening hole 223*h* is formed may be provided on an upper surface 223 of the connection part 222 of the inner body 220, and a screw through boss 234 in which a screw through hole 233*h* is formed at a position corresponding to the screw fastening hole 223*h* may be provided on a lower surface of the connection pad 231 of the arm support pad 230.

The arm support pad 230 may be rotatably connected to the connection part 222 of the inner body 220 by allowing the hinge screw 240 to pass through the screw through hole 233*h* through the screw installation hole 235 of the safety space S side in a state in which the hole cover 237 has been removed and then to be fastened to the screw fastening hole 223*h*.

Here, a flat washer 241 may be interposed in the hinge screw 240 as shown in FIG. 5. The flat washer 241 may be supported by a head portion of the hinge screw 240 passing therethrough and at the same time, provided so that an edge end portion supports a peripheral portion of the screw through hole 233*h* of a bottom surface of the screw installation hole 235 to function to transmit the user's assembly force transmitted to the hinge screw 240 to the arm support pad 230 and support the arm support pad 230 when rotating.

In addition, the flat washer 241 may function to mediate the transmission of the assembly force transmitted from the user to a ring-shaped compression boss 236 formed integrally with a lower end portion of the connection pad 231 to compress a frictional ring 225 to be described below.

Meanwhile, as shown in FIGS. 5 to 7B, the armrest assembly 200 according to one embodiment of the present disclosure may further include the frictional ring 225 disposed between the inner body 220 and the arm support pad 230 and providing a frictional force between the inner body 220 and the arm support pad 230 when the arm support pad 230 rotates with respect to the inner body 220.

Here, the frictional ring 225 may be an elastic body made of a rubber material. Therefore, the frictional ring 225 may be elastically deformed when the assembly force of the hinge screw 240 is transmitted by the ring-shaped compression boss 236 to be described below.

The frictional force by the frictional ring 225 may be determined by the assembly force of the hinge screw 240 connecting the inner body 220 to the arm support pad 230.

More specifically, the frictional ring 225 may be disposed between the inner body 220 and the arm support pad 230 and elastically compressed by the assembly force transmitted through the hinge screw 240 to generate a frictional force on the respective contact surfaces between the two components (the inner body 220 and the arm support pad 230), thereby preventing the arm support pad 230 from rotating arbitrarily when a predetermined assembly force or more is not transmitted.

To this end, a circular installation groove 224 may be formed in the upper surface of the connection part 222, and the frictional ring 225 may be seated in the circular installation groove 224. The circular installation groove 224 may be formed in a form in which a non-continuous arc-shaped rib protrudes upward.

In addition, the ring-shaped compression boss 236 may be formed on the lower surface of the connection pad 231 of the arm support pad 230 so as to be formed to have a larger diameter than the screw through boss 234. The ring-shaped compression boss 236 functions to uniformly compress an upper surface of the frictional ring 225 when the hinge screw 240 is fastened to the screw fastening hole 223*h*.

In this way, the uniform compression force of the ring-shaped compression boss 236 on the frictional ring 225 is an operating force adjusted by the user through the hinge screw 240, and at least the frictional ring 225 needs to be formed of an elastic body capable of elastic deformation at a predetermined hardness in order to provide a frictional force corresponding to the above operating force to the ring-shaped compression boss 236.

In this case, as shown in FIG. 5, when the frictional ring 225 is formed in a structure that may rotate in conjunction with the ring-shaped compression boss 236 without a separate locking structure, when the hardness of the frictional ring 225 is low, there are problems that a tearing phenomenon due to intermittent operation accumulation may occur and the operating force is set differently for each product regardless of the degree of adjustment of the hinge screw 240 depending on whether the frictional ring 225 rotates in conjunction with the ring-shaped compression boss 236.

Therefore, as shown in FIG. 6, a plurality of locking protrusions 225*a* protruding downward from the lower surface of the frictional ring 225 may be formed on the frictional ring 225. Since the plurality of locking protrusions 225*a* of the frictional ring 225 formed in this way are respectively fixedly inserted into a plurality of locking grooves 224*a* formed in the circular installation groove 224 to generate a general uniform frictional force without rotating in conjunction with the ring-shaped compression boss 236, it is possible to solve the problem that the operating force is different for each product.

The frictional ring 225 may also be applied to the relative rotation structure between the connection pad 231 and the support pad 232, and it goes without saying that a modified embodiment according to the structure of the plurality of locking protrusions 225*a* and the plurality of locking grooves 224*a* may also be applied to the frictional ring 225 in this case.

Meanwhile, a plurality of grooves 238 may be repeatedly formed in an outer circumferential surface of the ring-shaped compression boss 236 in a circumferential direction as shown in FIG. 4B, and an operation sense provision part 226 elastically supported toward the plurality of grooves 238 to provide the sense of operation when the arm support pad 230 rotates may be further provided on the upper surface of the connection part 222 of the inner body 220 as shown in FIG. 4A.

Here, as shown in FIG. 7B, the operation sense provision part 226 may include a member case 227 having an installation space (no reference numeral) that is open toward the plurality of grooves 238 in the upper surface of the connection part 222 of the inner body 220, an elastic rubber 228 provided inside the installation space in the member case 227, and an operation pin 229 having an inner end supported by the elastic rubber 228 and a portion of an outer surface supported to be engaged with the plurality of grooves 238.

When the user holds the arm support pad 230 by hand and rotates the arm support pad 230 in a desired direction, the sense of operation generated as the operation pin 229 elastically supported by the elastic rubber 228 sequentially passes over the plurality of grooves 238 is conversely transmitted to the user so that the user may receive a predetermined sense of operation (sense of manipulation).

The operation effects of the armrest assembly 200 according to one embodiment of the present disclosure configured as described above will be briefly described with reference to the accompanying drawings as follows.

First, as shown in FIG. 3, when the user holds the arm support pad 230 by hand and rotates the arm support pad 230 in the desired direction, the front end portion of the arm support pad 230 rotates to one side or the other side using the hinge screw 240 as the hinge center.

In this case, the frictional ring 225 provided between the connection part 222 of the arm support pad 230 and the inner body 220 may rotate while forming different frictional forces according to the assembly force according to the pre-adjustment of the hinge screw 240.

Here, the rotational force (frictional force) of the arm support pad 230 that is suitable for each user may be adjusted by removing the hole cover 237 and then adjusting the assembly force of the hinge screw 240 using a simple tool.

In this case, as shown in FIGS. 7A and 7B, the frictional ring 225 may be designed to be uniformly supported by being compressed by the ring-shaped compression boss 236 and can prevent the direct contact assembly of the hinge screw 240 with the arm support pad 230 via the flat washer 241, thereby preventing random loose of the hinge screw 240.

As described above, according to the armrest assembly 200 and the chair 100 including the same according to one embodiment of the present disclosure, it is possible to minimize manipulation noise by generating the uniform frictional force through the frictional ring 225 between the arm support pad 230 and the inner body 220 when the arm support pad 230 rotates and to simply adjust the rotational force (frictional force) desired by the user for each user.

The armrest assembly 200 and the chair 100 including the same according to one embodiment of the present disclosure have been described above in detail with reference to the accompanying drawings. However, it goes without saying that the embodiments of the present disclosure are not necessarily limited by the above-described embodiments, and various modifications and implementation within the equivalent scope are possible by those skilled in the art to which the present disclosure pertains. Therefore, the true scope of the present disclosure will be determined by the claims to be described below.

The present disclosure provides an armrest assembly and a chair including the same, which are capable of customizing a rotational force (manipulation force) of an arm support pad for each user by adjusting the fastening strength of a hinge screw and prevent random loose of the hinge screw through the even distribution design of the frictional force through a frictional ring.

The invention claimed is:

1. An armrest assembly comprising:

an arm frame body in which an inner space with an open upper end portion is formed and which mediates coupling to a seat part on which a user sits;

an inner body disposed by being inserted into the inner space of the arm frame body and disposed to be moved vertically by the user's manipulation;

an arm support pad which is connected to an upper portion of the inner body, on which the user's arms are supported by being rested, and which is provided to have a front end portion rotated by an external force provided by the user in a horizontal direction; and a frictional ring disposed between the inner body and the arm support pad and providing a frictional force between the inner body and the arm support pad when the arm support pad rotates with respect to the inner body, wherein the frictional force by the frictional ring is determined by an assembly force of a hinge screw connecting the inner body to the arm support pad, wherein the inner body is provided with a screw fastening boss in which a screw fastening hole is formed, and the arm support pad is provided with a screw through boss in which a screw through hole is formed at a position corresponding to the screw fastening hole, and the frictional ring is compressed as a ring-shaped compression boss formed to protrude to the lower portion of the arm support pad is moved downward by an assembly force of the hinge screw fastened to the screw fastening hole of the screw fastening boss through the screw through hole of the screw through boss.

2. The armrest assembly of claim 1, wherein the inner body includes a height adjustment case inserted into the inner space of the arm frame body to adjust a height and a connection part provided at an upper end of the height adjustment case and mediating the relative rotation connection of the arm support pad, and the frictional ring is seated in a circular installation groove formed in an upper surface of the connection part.

3. The armrest assembly of claim 2, wherein the frictional force is determined as an upper end portion of the frictional ring is compressed by a lower end portion of a ring-shaped compression boss protruding to a lower portion of the arm support pad.

4. The armrest assembly of claim 2, wherein the frictional ring is formed with a plurality of locking protrusions protruding downward from a lower surface thereof, and the plurality of locking protrusions are fixedly inserted into a plurality of locking grooves formed in the circular installation groove.

5. The armrest assembly of claim 1, wherein the frictional ring is an elastic body made of a rubber material.

6. The armrest assembly of claim 1, wherein a flat washer is interposed in the hinge screw to mediate transmission of an assembly force transmitted from the user to the ring-shaped compression boss.

7. The armrest assembly of claim 2, wherein a plurality of grooves are repeatedly formed in an outer circumferential surface of the ring-shaped compression boss in the circumferential direction, and an operation sense provision part elastically supported toward the plurality of grooves to provide the sense of operation when the arm support pad rotates is further provided on the upper surface of the connection part of the inner body.

8. The armrest assembly of claim 7, wherein the operation sense provision part includes:

a member case having an installation space that is open toward the plurality of grooves in the upper surface of the connection part of the inner body;

an elastic rubber provided inside the installation space in the member case; and an operation pin having an inner end supported by the elastic rubber and a portion of outer surfaces supported to be engaged with the plurality of grooves.

9. A chair comprising:

a seat part provided so that a user sits thereon; and an armrest assembly provided on both left and right end portions of the seat part and provided so that the user's arms are rested, wherein the armrest assembly includes:

an arm frame body in which an inner space with an open upper end portion is formed and which mediates coupling to the seat part;

an inner body disposed by being inserted into the inner space of the arm frame body and disposed to be moved vertically by the user's manipulation;

an arm support pad which is connected to an upper portion of the inner body, on which the user's arms are supported by being rested, and which is provided to have a front end portion rotated by an external force provided by the user in a horizontal direction; and a frictional ring disposed between the inner body and the arm support pad and providing a frictional force between the inner body and the arm support pad when the arm support pad rotates with respect to the inner body, wherein the frictional force by the frictional ring is determined by an assembly force of a hinge screw connecting the inner body to the arm support pad, wherein the inner body is provided with a screw fastening boss in which a screw fastening hole is formed, and the arm support pad is provided with a screw through boss in which a screw through hole is formed at a position corresponding to the screw fastening hole, and the frictional ring is compressed as a ring-shaped compression boss formed to protrude to the lower portion of the arm support pad is moved downward by an assembly force of the hinge screw fastened to the screw fastening hole of the screw fastening boss through the screw through hole of the screw through boss.

* * * * *